United States Patent [19]

Reiner

[11] Patent Number: 4,675,078

[45] Date of Patent: Jun. 23, 1987

[54] WEB FORMING METHOD AND DEVICE

[75] Inventor: Per L. Reiner, Matfors, Sweden

[73] Assignee: Molnlycke Aktiebolag, Sweden

[21] Appl. No.: 674,359

[22] Filed: Nov. 21, 1984

Related U.S. Application Data

[63] Continuation of Ser. No. 435,651, Oct. 21, 1982, abandoned.

[30] Foreign Application Priority Data

Nov. 10, 1981 [SE] Sweden ..... 8106648
Sep. 28, 1982 [SE] Sweden ..... 8205527

[51] Int. Cl.[4] ..... D21F 1/06

[52] U.S. Cl. ..... 162/344; 162/345; 162/347

[58] Field of Search ..... 162/210, 214, 317, 347, 162/312, 291, 295, 344, 345

[56] References Cited

U.S. PATENT DOCUMENTS

| | | | |
|---|---|---|---|
| 2,418,600 | 4/1947 | Ostertag et al. | 162/214 |
| 3,079,990 | 3/1963 | Taylor et al. | 162/350 |
| 3,645,843 | 2/1972 | Schmaeng | 162/347 |
| 3,839,149 | 10/1974 | Justus et al. | 162/317 |
| 4,416,730 | 11/1983 | Schiel | 162/344 |

FOREIGN PATENT DOCUMENTS

| | | |
|---|---|---|
| 20080 | 12/1935 | Australia . |
| 109249 | 12/1939 | Australia . |
| 109860 | 2/1940 | Australia . |
| 154135 | 11/1950 | Australia . |
| WO80/02575 | 11/1980 | PCT Int'l Appl. . |

*Primary Examiner*—Peter Chin
*Attorney, Agent, or Firm*—Lerner, David, Littenberg, Krumholz & Mentlik

[57] ABSTRACT

A method and a device for forming a web in a papermaking machine. The stock (2) is sprayed out on the wire (3) through a nozzle (1) and the web is formed in a space (8) between an upper lip (5, 18, 19) and a portion of the wire (3). The dewatering is effected in this space (8) by means of an overpressure between the upper lip (5, 18, 19) and the wire (3).

15 Claims, 6 Drawing Figures

WEB FORMING METHOD AND DEVICE

This is a continuation of application Ser. No. 435,651 filed on Oct. 21, 1982, now abandoned.

BACKGROUND OF THE INVENTION

This invention relates to a method of forming a web in a papermaking machine and to a device for caryring out the method.

At the manufacture of paper in a papermaking machine it is of extreme importance for the properties of the paper product, that the web is formed in the wet section of the machine under controlled conditions. Normally, the pulp suspension (stock) is sparyed in the form of a free jet from the head box onto the wire, where it is dewatered and a different disturbances, such as for example incomplete dispersion of the fibres in the stock, non-uniform outflow of the stock from the head box, difference in speed between the stock jet and wire, non-uniform dewatering owing to unsuitable or defect dewatering members. It is particularly difficult to grapple with the two first mentioned disturbances. For geometric-mechanic reasons, the fibres have a tendency to flocculate. This flocculation tendency is accentuated at increasing fibre concentration and length. For being able to make a paper with good formation, the fibre flocks in the stock must be well dispersed. This can be achieved by a very low fibre concentration which, however, in most cases is less attractive as it requires the handling of large flow amounts. Fibre flocks also can be broken down by a fine-scale turbulence of sufficient intensity. It was experienced in practice, however, that this implies to choose between two evils. The turbulence generated has often a relatively wide spectrum, i.e., relatively coarse-scale turbulence is mixed with a fine-scale one. The fine scale turbulence decays rapidly, whereby also a rapid reflocculation takes place. The eddies rich in energy are kept alive for a longer time and often have the opportunity of following along with the flow out of the head box. When the turbulence level in the jet from the head box is too high, the jet geometry (originally determined by the lip geometry) is changed. The thickness of the stock jet varies locally along and transversely to the machine direction. As the substance of the sheet formed depends on the thickness of the stock layer across the wire, the substance, thus, will vary from one position to the other in the web.

The aforesaid problem, which often implies insufficient deflocculation of the stock when the necessary turbulence level would yield an unacceptable disturbance for the forming of the sheet on the wire, of course, is still more serious in a Fourdrinier machine than in a twin-wire machine. The jet length in a twin-wire machine generally is short, and dewatering proceeds rapidly. There is, thus, not sufficient time for thickness variations in the stock to develop to the same extent as in a Fourdrinier machine.

In a Fourdrinier machine the dewatering, to a state at which the individual fibres are fixed in a fibre bed, is effected by vacuum by means of dewatering members of different types: forming tables, wire carrying rolls, foils, wet section boxes. All of these have in common, besides their primary object of dewatering, that they, to a greater or smaller extend, introduce disturbances into the stock layer. As one example the dewatering by means of foils can be described. A foil strip is positioned at a certain angle in relation to the wire so as to form a divergent space with the wire in the machine direction. When the wire with the stock layer advances at high speed over the foil, a vacuum is created in the diverging space which effects the dewatering. A greater or smaller amount of the water drained off follows along with the wire on its lower surface all the way to the next following foil strip, on the leading edge of which the water is scraped off. This scraping-off of the water gives rise to a pressure pulse directed upward to the wire and the sheet formed lying thereabove. The size of the pressure pulse is a function of the water amount scarped off, the scraping-off angle and the wire speed. For reasons discussed above, in the stock on its way from the head box there prevails often a flocking condition, which is unacceptable for the forming of the paper. The pressure pulses arising at the leading edge of the foil strips introduce shearing forces into the stock above the wire which in an early phase of the sheet forming process yield a positive deflocculating effect. This effect, however, is difficult to control, and pulses which are too strong in a somewhat later phase of the sheet forming process can break down a fibre network already formed on the wire and thereby have a negative effect on the sheet forming.

In order to solve the aforesaid problems, different methods and structural designs have been proposed. It is known, for example, to employ a nozzle on a head box, with an upper lip extending forward over the wire in the movement direction thereof and over a dewatering member located beneath the wire. The object of this arrangement is to establish between the upper lip and the wire a converging space, which is adjusted to dewatering rate, and thereby to be able to maintain the stock flow in this space at a constant rate. Hereby, during the greater part of the dewatering process a stock layer is obtained which is well-defined by the extended upper lip and the wires, and in which hydrodynamic disturbances generated in the head box are not given the possibility to develop. In some cases the converging space between the extended upper lip and the wire is defined as to its form in that the upper lip is stiff and the wire is supported by a dewatering member yielding a certain stretching of the wire. The dewatering member may be a suction breast roll or a plane suction box. The appearance of the suction box may vary. The open area in the suction box cover may be a pattern of holes or slits extending transversely to the machine. All suction box covers have in common, that the open area and, respectively, land area are arranged so that the wire is supported in a manner implying a minimum of deflection in the suction zones. The suction box may be so divided into sections, that in the different sections varying vacuum levels can be applied. The dewatering has to correspond to the forming space and by this arrangement efforts are made to control the dewatering rate so that it is adjusted to the converging forming space. However, as discussed above for foils, a support beneath the wire during a dewatering phase implies that pressure pulses are directed upward to the wire and can exert a breaking-down effect on the sheet formed. As the fibre network formed is not affected over the land areas by stabilizing suction forces, the situation is deteriorated additionally.

In order to eliminate these problems, the extended upper lip has been designed flexible, at the same time as the wire portion laying beneath has not been given any support at least during the final forming phase. The dewatering is effected by means of vacuum in an open suction box located beneath the wire. This implies, yet, that sealings are required along the edges of the suction box, which results in disturbances in the edge zones of the web. The dewatering rate, furthermore, is restricted by the vacuum available in the suction box.

SUMMARY OF THE INVENTION

The present invention has the object to additionally improve and simplify the forming of a web. This is achieved in that the dewatering of the pulp suspension (stock) is carried out by means of an overpressure between the upper lip and the wire, as set fourth in the claims.

The vacuum on the lower surface of the wire can thereby be reduced. The dewatering preferably is carried out entirely without vacuum. Thereby, disturbances are eliminated, which disturbances would arise due to sealing strips primarily along the edges of a suction box. The overpressure can be effected by a flexible upper lip, which is loaded with a constant or varying over pressure along the forming zone in the flow direction of the stock. The pressure preferably can be maintained to be lowest at the beginning of the forming zone where the dewatering resistance is lowest. Thereafter the pressure increases successively along the forming zone as the paper web is formed and the dewatering resistance increases.

The overpressure also can be effected by a resilient upper lip, which is pressed against an unsupported portion of the wire. The pressure can vary in that the upper lip has a varying stiffness along the forming zone in the flow direction of the stock. The pressure is proportional to the wire tension and inversely proportional to the radius of curvature of the upper lip. In order to bring about the desired successive inrease in pressure along the forming zone, the upper lip is designed with a stiffness decreasing along the forming zone. The radius of curvature of the upper lip then decreases whereby the pressure along the forming zone increases.

It is also possible to effect the overpressure by means of a rigid upper lip with a predetermined form. The wire is pressed against the upper lip and the pressure distribution along the forming zone then is determined by the raduis of curvature of the upper lip, as stated above. It is, thus, possible by the configuration of the upper lip to determine the relative pressure distribution along the forming zone, and by the wire tension to determine the size of the overpressure.

According to the inention, the hydrodynamic disturbances in a papermaking machine can be damped efficiently across the entire width of the web. This implies that the web substance can be maintained more uniform. The stock concentration in the head box may be high, without disturbing the forming process. This is especially advantageous at the making of paper with high bulk. As the dewatering pressure can be adjusted as desired, the dewatering capacity and therewith the machine speed can be increased.

A method of forming a web in a papermaking machine wherein a pulp suspension flows out onto a wire through a nozzle of a papermaking machine and is formed in a space between an upper lip projecting from the nozzle and a portion of the wire, the method comprising the step of dewatering one pump suspension by applying an overpressure tothe pump suspension between the upper lip and the wire of the papermaking machine.

A device for forming a web ina papermaking machine, the device comprising a wire, a nozzle for supplying a pulp suspension onto the wire, and an upper lip projecting from the upper portion of the nozzle defining a forming space between the upper lip and a portion of the wire, wherein the upper lip and wire are capable of being pressed against each other for applying an overpressure to the pulp suspension in the forming space for dewatering the pulp suspension therebetween.

BRIEF DESCRIPTION OF THE DRAWINGS

The invention is described in the following by way of some embodiments, with reference to the drawings in which.

Figure 1:
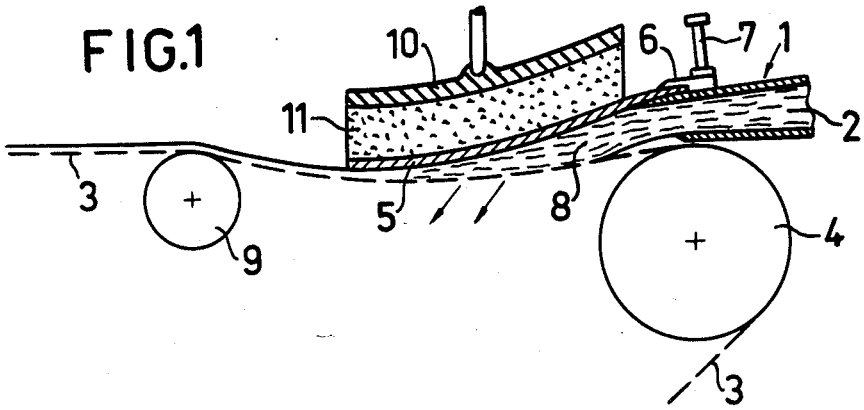
FIGS. 1–4 show paper making machines with a flexible upper lip.

Each embodiment comprises a nozzle 1 on a head box (not shown). The stock 2 is sparyed through the nozzle 1 out onto the wire 3 which passes over a breast roll 4, 14. From the upper portion of the nozzle 1 an upper lip 5, 18, 19 extends, which is attached on the nozzle. The nozzle 1 is directed so that the angle formed between the stock jet and the wire is small. Between the upper lip 5, 18, 19 and the wire 3 a forming space 8 for the web is formed.

According to FIG. 1 the flexible upper lip 5 is attached to the nozzle 1 by fastening means 6. The nozzle orifice can be adjusted by an adjusting device 7. The portion of the wire which is located beneath the flexible upper lip 5 is unsupported in its entire width and this unsupported portion extends through a distance past the upper lip 5 all the way to a supporting roll 9. Thereby no disturbances arise when the web leaves the forming space 8.

The flexible upper lip 5 is exposed to a static pressure by a pressure means 10. Between the pressure means 10 and the upper lip 5, a member 11 is located which distributes the pressure on the upper lip. Said member 11 may be of elastic material, for example foamed plastic or air cushions. By controlling the pressure, the dewatering can be controlled.

Figure 2:
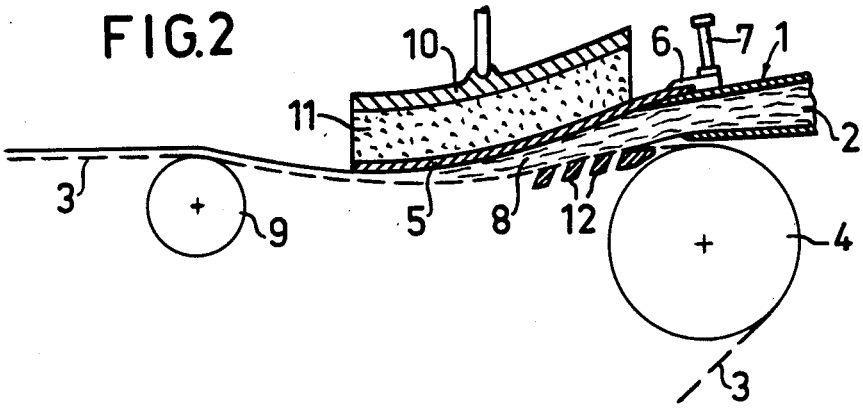

FIG. 2 shows an embodiment which corresponds to FIG. 1, but where the wire is supported by strips 12 or the like in the entrance portion of the forming space 8. Thereby an inreased microturbulence in the stock in the entrance portion of the forming space can be created. Shearing forces are introduced into the flow and exert a deflocculating effect on the stock whereby the formation of the sheet in certain cases can be additionally improved. A loosening effect on the fibre network already formed is obtained simultaneously whereby the continued dewatering can be facilitated.

Figure 3:
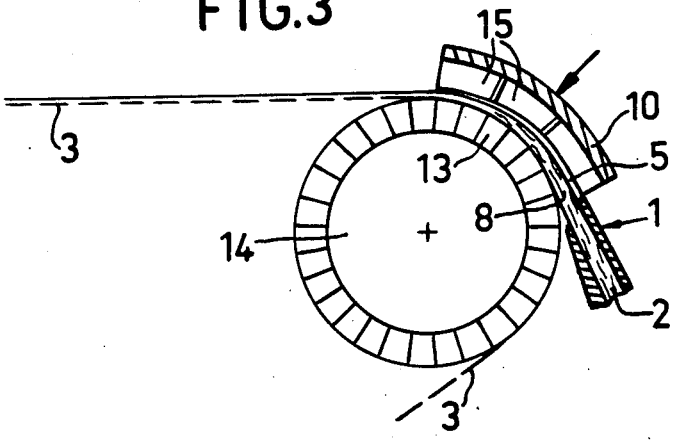

FIG. 3 shows an embodiment where the web forming is effected on a breast roll 14 formed with dewatering members 13. The wire 3 here is supported beneath the forming space 8 by the breast roll 14. Elastic material in the form of air cushions 15 are arranged between the pressure means 10 and the upper lip 5.

Figure 4:
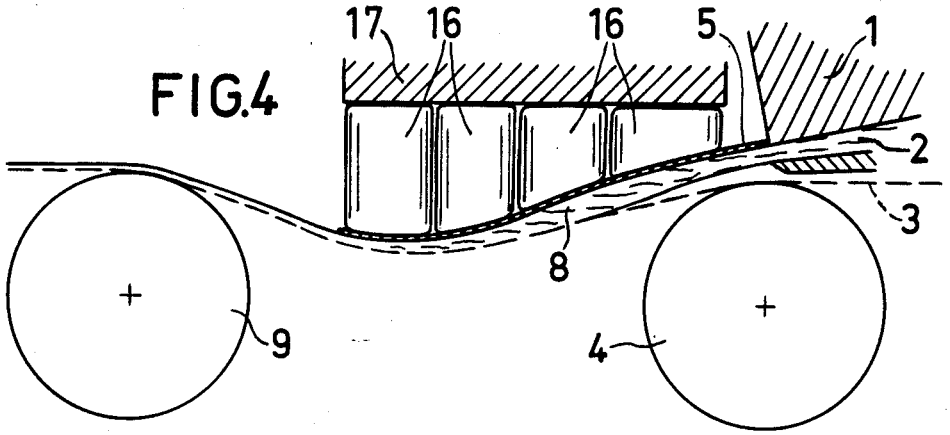
Figure 5:
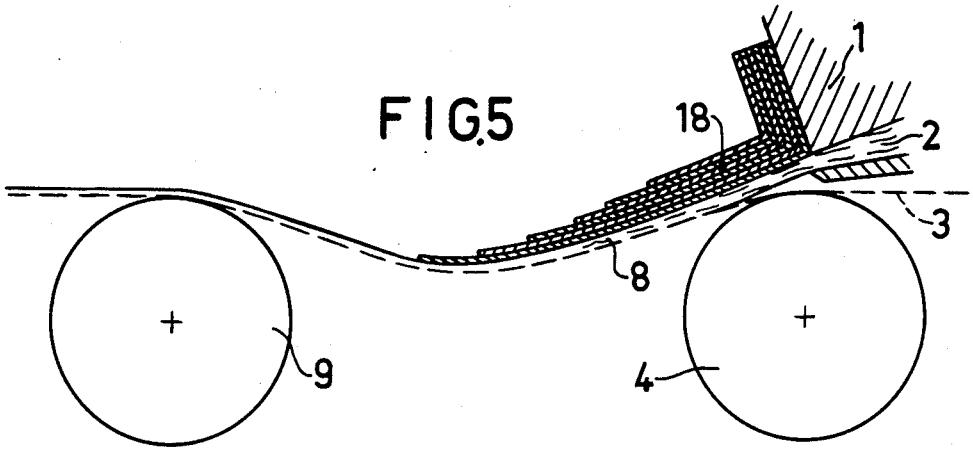
FIG. 5 shows a paper making machine with a resilient upper lip and FIG. 6 shows a paper making machine with a rigid upper lip.
Figure 6:
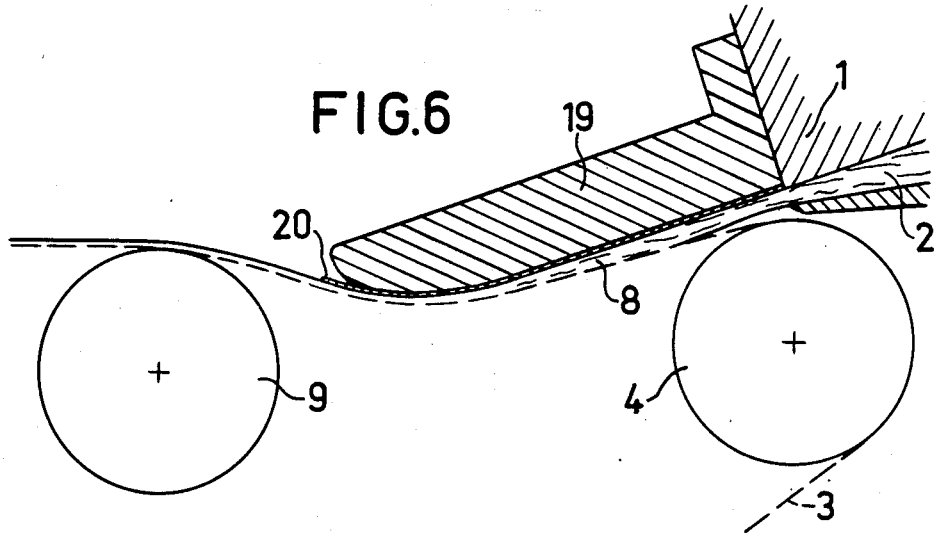

According to FIGS. 4, 5 and 6 the portion of the wire 3 which is located beneath the upper lip 5, 18, 19 is unsupported in its entire width. This unsupported portion extends through a distance past the upper lip 5, 18, 19 all the way to a supporting roll 9.

According to FIG. 4, the upper lip 5 is flexible and subjected to a pressure varying in the flow direction of the stock 2 by means of a plurality of air cushions 16, which operate against a rigid counterhold 17. The pressure in each air cushion 16 is variable and preferably is adjusted so that the pressure against the upper lip 5 increases in the flow direction of the stock 2.

According to FIG. 5 the upper lip 18 is resilient, and its stiffness decreases in the flow direction of the stock 2. The upperlip 18 is pressed against the wire 3, preferably by turning the entire nozzle 1, and thereby assumes curved shape. Due to the decreasing stiffness, the radius of curvature decreases continuously in the flow direction of the stock 2 at the same time as the pressure increases. In order to bring about the decrease in stiffness of the upperlip 18, the upperlip can be designed with decreasing thickness, for example by metal sheets located one upon the other and having different length, as appears from FIG. 5. A flexible upper lip may possibly be provided beneath the resilient upper lip 18.

According to the embodiment shown in FIG. 6, the upper lip 19 is rigid, i.e., its form cannot be affected during the forming process. The radius of curvature of the upper lip 19, and therewith the pressure distribution in the flow direction of the stock 2, cannot be changed. The size of the pressure, however, can be adjusted by the wire tension or by pressing the upper lip 19 against the wire 3, preferably by turning the entire nozzle 1. The radius of curvature preferably shall decrease continuously in the flow direction of the stock 2. A pressing of the rigid upper lip 19 against the wire 3 also means that the length of the forming space 8 increases. Thereby a decreasing radius of curvature at the end of the upper lip 19 will further increase the overpressure at the end of the forming space 8. The rigid upper lip 19 terminates with a flexible lip 20, which prevents disturbances in the web in the diverging zone being formed between the end of the rigid upper lip 19 and the wire 3. the flexible lip 20 possibly may extend along the entire lower surface of the rigid upper lip 19.

The control according to the invention of the forming of the web in the space 8 implies that the stock concentration in the head box can amount to ½–1% at the making of paper with low substance, and 3–5% at the making of paper with high substance and pulp sheets. Furthermore, the wear of the wire can be reduced to minimum when the wire is freely supported between two rolls in the forming zone.

The upper lips shown have a smooth lower surface. In order to bring about a high microturbulence in the stock at the beginning of the forming space, the upper lips can be provided on their lower surfaces with small unevennesses, which introduce shearing forces into the flow and cause a deflocculating effect on the stock. Hereby the formation of the sheet can in certain cases be improved still more.

The invention, of course, is not restricted to the embodiments described aboe, but can be varied within the scope of the invention idea.

What is claimed is:

1. A vacuumless device for forming a web in a papermaking machine, said device comprising a wire having an unsupported portion, a nozzle for supplying a pulp suspension onto said wire in the form of a free jet, said nozzle having an upper portion, an upper lip having a radius of curvature varying in the flow direction of said pump suspension and defining a curved shape projecting away from said uper portion of said nozzle in the flow direction of said pulp suspension so as to define a pulp forming space between said upper lip and said unsupported portion of said wire, said upper lip being of resilient construction, and pressing means arranged overlying a portion of said unsupported portion of said wire for pressing said upper lip against said unsupported portion of said wire with sufficient overpressure for dewatering said pulp suspension therebetween in the absence of a vacuum by applying an overpressure to said pulp suspension in said forming space, said upper lip and said unsupported portion of said wire being pressed against each other by said pressing means with an overpressure which varies successively along said forming space in the flow direction of said pulp suspension, the variations in said overpressure corresponding to the variations in said radius of curvature of said upper lip.

2. The device as set forth in claim 1, wherein said upper lip is of flexible construction.

3. The device as set forth in claim 1 further including an elastic member arranged between said pressing means and said upper lip for distributing said overpressure created by said pressing means over said upper lip.

4. The device set forth in claim 1, wherein said upper lip comprises a flexible lip and a plurality of adjacent air cushions having a pressure therein successively increasing in the flow direction of said pulp suspension, said air cushions being arranged to apply a variable overpressure to said pulp suspension over said flexible lip.

5. The device as set forth in claim 1, wherein said upper lip comprises a plurality of sheets located one upon the other and each having a different length.

6. The device as set forth in claim 1, wherein said upper lip has a stiffness decreasing successively in the flow direction of said pump suspension.

7. The device as set forth in claim 1, wherein said upper lip is of rigid construction having a radius of curvature varying in the flow direction of said pulp suspension.

8. The device as set forth in claim 7 further including a second lip of flexible construction attached to said upper lip of rigid construction, said second lip extending past the free end of said upper lip of rigid construction.

9. The device as set forth in claim 1, wherein said nozzle supplies said pulp suspension onto said unsupported portion of sid wire in the extending direction thereof.

10. A device for forming a web in a paper making machine, said device comprising a wire having an unsupported portion, a nozzle for supplying a pulp suspension onto said wire in the form of a free jet, an upper lip having a radius of curvature varying in the flow direction of said pulp suspension and defining a curved shape projecting from the upper portion of said nozzle defining a forming space between said upper lip and said unsupported portion of said wire, and pressing means for pressing said upper lip having a curved shape and said unsupported portion of said wire against each other for applying an overpressure to said pulp suspension in said forming space for dewatering said pulp suspension therebetween, said upper lip having a curved shape being of resilient construction, said upper lip and said unsupported portion of wire being pressed against each other by said pressing means with an overpressure which varies successively along said forming space in the flow direction of said pulp suspension, the variations in said overpressure corresponding to the variations in said radius of curvature of said upper lip.

11. The device as set forth in claim 10, wherein said upper lip having a curved shape comprises a flexible lip and an elastic member arranged to distribute said overpressure from said pressing means over said flexible lip.

12. The device as set forth in claim 10, wherein said upper lip having a curved shape and an unsupported portion of said wire are capable of being pressed against each other with an overpressure which is variable successively along said forming space in the flow direction of said pulp suspension.

13. The device as set forth in claim 12, wherein said upper lip having a curved shape comprises a flexible lip and a plurality of adjacent air cushions having a pressure therein successively increasing in the flow direction of said pulp suspension, said air cushions being arranged to apply said variable overpressure to said pulp suspension over said flexible lip.

14. The device as set forth in claim 12, wherein said upper lip having a curved shape has a stiffness decreasing successively in the flow direction of said pulp suspension.

15. The device as set forth in claim 14, wherein said upper lip having a curved shape comprises a plurality of sheets located one upon the other and each having a different length.

* * * * *

UNITED STATES PATENT AND TRADEMARK OFFICE
CERTIFICATE OF CORRECTION

PATENT NO. : 4,675,078

DATED : June 23, 1987

INVENTOR(S) : Per L. Reiner

It is certified that error appears in the above-identified patent and that said Letters Patent is hereby corrected as shown below:

Column 1:

Line 9, change "caryring" to --carrying--;

Line 17, after "a" insert --web is formed. The forming of the sheet is affected by a great number of--.

Column 2:

Line 12, change "scarped" to --scraped--.

Column 3:

Line 36, change "inrease" to --increase--;

Line 45, change "raduis" to --radius--;

Line 50, change "inention" to --invention--;

Line 66, change "tothe" to --to the--.
change "pump" to --pulp--;

Column 4:

Line 1, change "ina" to --in a--.

UNITED STATES PATENT AND TRADEMARK OFFICE

CERTIFICATE OF CORRECTION

PATENT NO. : 4,675,078

DATED : June 23, 1987

INVENTOR(S) : Per L. Reiner

It is certified that error appears in the above-identified patent and that said Letters Patent is hereby corrected as shown below:

Column 5:

Line 58, change "aboe" to --above--.

Column 6:

Line 48, change "sid" to --said--.

Signed and Sealed this

Twenty-ninth Day of December, 1987

*Attest:*

DONALD J. QUIGG

*Attesting Officer*

*Commissioner of Patents and Trademarks*